US006863423B2

(12) United States Patent
Stone et al.

(10) Patent No.: US 6,863,423 B2
(45) Date of Patent: Mar. 8, 2005

(54) LIGHTING FIXTURES HAVING RELEASABLY ATTACHABLE OBJECTS AND METHODS FOR TRIMMING LIGHTING FIXTURES

(75) Inventors: John D. Stone, Palmer Lake, CO (US); Todd B. Rugee, San Francisco, CA (US)

(73) Assignee: Boyd Lighting Fixture Company, San Francisco, CA (US)

( * ) Notice: Subject to any disclaimer, the term of this patent is extended or adjusted under 35 U.S.C. 154(b) by 0 days.

(21) Appl. No.: 10/346,234

(22) Filed: Jan. 17, 2003

(65) Prior Publication Data

US 2004/0141328 A1 Jul. 22, 2004

(51) Int. Cl.[7] ..... F21S 8/06

(52) U.S. Cl. ..... 362/404; 362/226; 362/405

(58) Field of Search ..... 362/226, 391, 362/404, 405, 406, 407, 457, 458, 403; D26/81, 82, 85, 86, 154; 248/303; 428/342, 343, 344

(56) References Cited

U.S. PATENT DOCUMENTS

| | | | | | |
|---|---|---|---|---|---|
| 2,117,137 | A | | 5/1938 | Blatz | 59/78.1 |
| 2,753,445 | A | | 7/1956 | Thomas et al. | 240/78 |
| 3,943,353 | A | * | 3/1976 | Tada | 362/404 |
| 3,979,584 | A | * | 9/1976 | Fossati | 362/405 |
| 4,273,405 | A | | 6/1981 | Law | 339/94 R |
| 4,634,307 | A | * | 1/1987 | Gnaedinger et al. | 403/194 |
| 4,676,573 | A | * | 6/1987 | Norman | 439/318 |
| 4,789,759 | A | | 12/1988 | Jones | 174/65 |
| 5,104,082 | A | * | 4/1992 | Bayer | 248/303 |
| 5,181,777 | A | * | 1/1993 | Segill et al. | 362/405 |
| 5,241,460 | A | * | 8/1993 | Schonbek | 362/405 |
| 5,285,364 | A | * | 2/1994 | Bayer | 362/405 |
| 5,317,493 | A | | 5/1994 | Muller et al. | 362/407 |
| 5,339,618 | A | | 8/1994 | Sawyer | 59/93 |
| 5,567,046 | A | * | 10/1996 | Lucas | 362/405 |
| 5,773,758 | A | | 6/1998 | Coutureau et al. | 174/65 R |
| 6,126,305 | A | | 10/2000 | Swarovski | 362/565 |
| 6,155,526 | A | * | 12/2000 | Brown | 248/303 |
| 6,317,632 | B1 | * | 11/2001 | Krig et al. | 607/14 |
| 6,517,223 | B2 | * | 2/2003 | Hsu | 362/405 |
| 6,565,240 | B1 | * | 5/2003 | Wu | 362/405 |
| 6,761,342 | B1 | * | 7/2004 | Giefer et al. | 248/343 |

OTHER PUBLICATIONS

John Sweet Sr., Untitled light fixture, displayed at the Dallas Fairmont Hotel in the Pyramid Room, about 1964.

GripLock Gliders available from Griplock Systems of Carpinteria, California, http://www.griplocksystems.com, 3 pages.

Rugee, pending U.S. design patent application Ser. No. 29/174,442, filed Jan. 17, 2003, entitled "Lighting Fixture".

Rugee, pending U.S. design patent application Ser. No. 29/174,445, filed Jan. 17, 2003, entitled "Lighting Fixture".

Rugee, pending U.S. design patent application Ser. No. 29,174,441, filed Jan. 17, 2003, entitled "Lighting Fixture".

Rugee, pending U.S. design patent application Ser. No. 29/174,446, filed Jan. 17, 2003, entitled "Lighting Fixture".

* cited by examiner

*Primary Examiner*—Sandra O'Shea
*Assistant Examiner*—Hargobind S. Sawhney
(74) *Attorney, Agent, or Firm*—Heslin Rothenburg Farley & Mesiti P.C.

(57) ABSTRACT

A lighting fixture includes a support, a plurality of objects such as crystal ornaments, and a plurality of quick-disconnect connectors connected to the support for hanging the plurality of objects from the support. The plurality of quick-disconnect connectors include a first self-locking position for connecting the plurality of objects to the support and a second releasable position for disconnecting the plurality of objects from the support. The plurality of quick-disconnect connectors may include a plurality of cable grips for suspending the plurality of objects. A method for trimming lighting fixture with objects such as ornaments, and a method for forming a lighting fixture are also disclosed.

33 Claims, 6 Drawing Sheets

LIGHTING FIXTURES HAVING RELEASABLY ATTACHABLE OBJECTS AND METHODS FOR TRIMMING LIGHTING FIXTURES

FIELD OF THE INVENTION

This invention relates generally to lighting fixtures, and more particularly, to lighting fixtures having releasably attachable objects and methods for trimming lighting fixtures.

BACKGROUND OF THE INVENTION

Lighting fixtures such as chandeliers typically include a central member with outwardly-extending arms which support crystal ornaments. Typically, each crystal ornament is separately attached to an arm with a wire. For example, a crystal ornament is typically attached to a wire and an upper end of the wire is wrapped or hooked onto one of the arms.

Various attempts have been made to provide lighting fixtures having releasably attachable ornaments. For examples, U.S. Pat. No. 3,979,584 issued to Fossati discloses a chandelier having coupling features whereby decorative elements may be easily added, removed or mounted in many alternative positions. The decorative elements may be inserted and locked into position by appropriate coupling fittings acting through interference or friction fits. One set of coupling fittings include a plurality of horizontal mounting apertures and the decorative elements include arms having a slotted pin which is received in the horizontal mounting apertures. Fossati also discloses slotted connector rings having a plurality of vertical openings for receiving, from above, an end of an arm of a decorative element.

U.S. Pat. No. 5,104,082 issued to Bayer discloses a chandelier hook for hanging chandelier ornaments. The hook has a pair of bends, one of which is adapted for engagement with an opening in a chandelier frame, and the other of which is adapted to resist accidental displacement of the ornaments from the chandelier frame.

U.S. Pat. No. 5,181,777 issued to Segill et al. discloses a lighting fixture such as a ceiling fixture adapted to surround a source of illumination. A set of translucent members are replacably assembled by a set of attachment members each of which has a hooked, upper end portion that is received on an associated one of a plurality of recesses in a bracket of the lighting fixture.

There is a need for further lighting fixtures having releasably attachable objects and methods for trimming lighting fixtures.

SUMMARY OF THE INVENTION

The present invention provides in a first aspect, a lighting fixture which includes a support, a plurality of objects, and a plurality of quick-disconnect connectors connected to the support for hanging the plurality of objects from the support. The plurality of quick-disconnect connectors have a first self-locking position for connecting the plurality of objects to the support and a second releasable position for disconnecting the plurality of objects from the support.

The present invention provides in a second aspect, a lighting fixture which includes a support having a horizontal bottom member, a plurality of objects each of which having an elongated pin, and a plurality of cable grips attached to the bottom member of the support for suspending the plurality of objects by the elongated pins from the support.

The plurality of cable grips have a first self-locking position for connecting the plurality of objects to the support and a second releasable position for disconnecting the plurality of objects from the support.

The present invention provides in a third aspect, a method for trimming a lighting fixture which the method includes connecting a plurality of objects to a support with a plurality of quick-disconnect connectors.

The present invention provides in a fourth aspect, a method for forming a light fixture in which the method includes providing a support, and attaching a plurality of quick-disconnect connectors to the support for connecting to a plurality of objects.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and accompanying drawings in which:

DETAILED DESCRIPTION OF THE INVENTION

Figure 1:
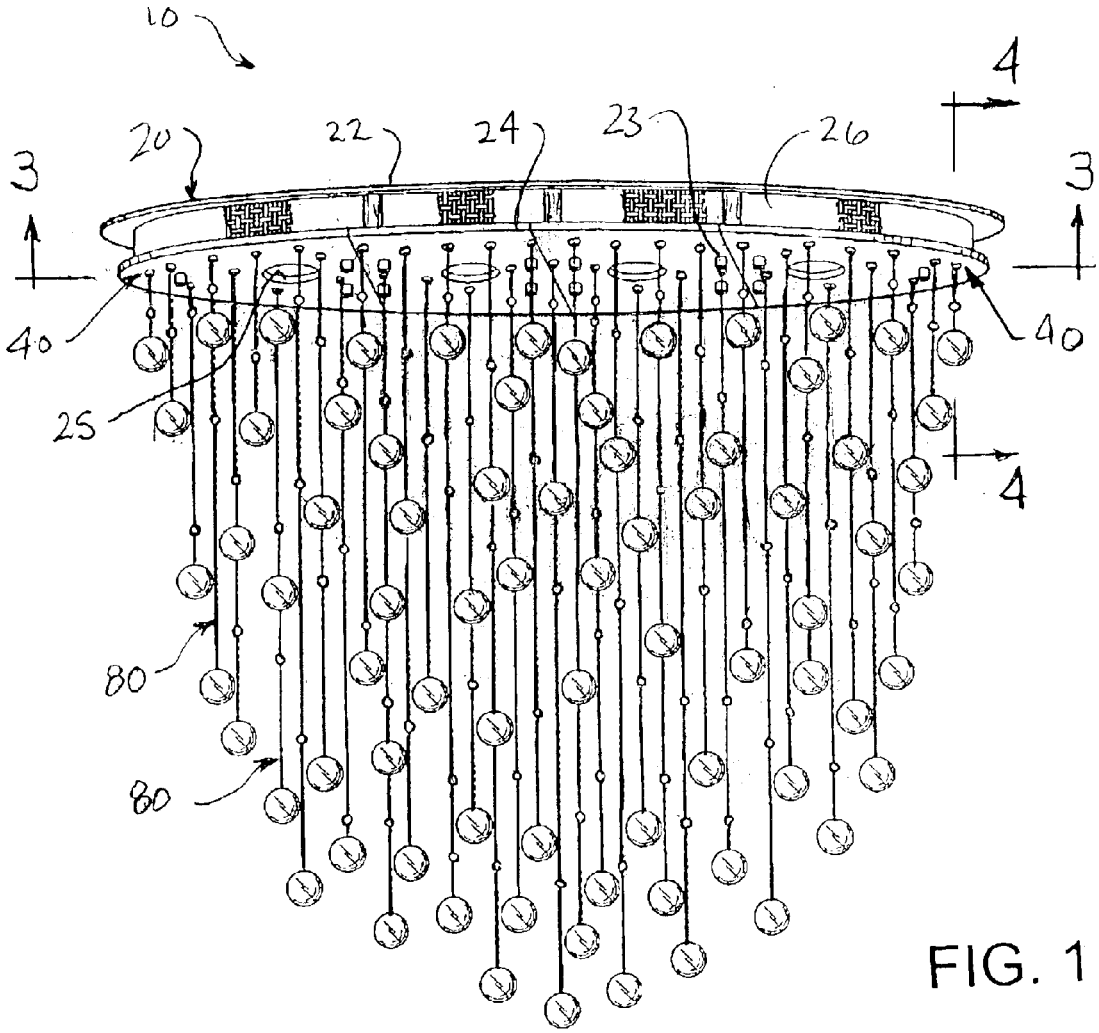
FIG. 1 is a perspective view of a lighting fixture having a plurality of releasably attachable objects in accordance with the present invention.
Figure 2:
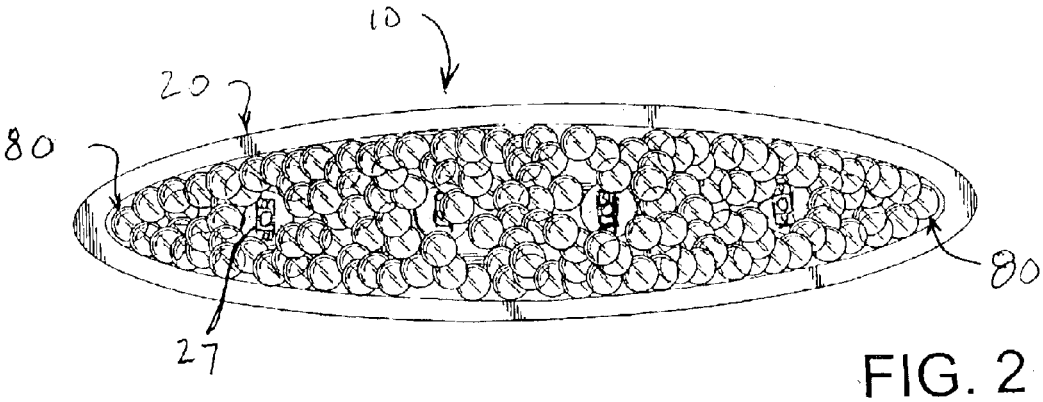
FIG. 2 is a bottom view of the lighting fixture of FIG. 1.

FIGS. 1 and 2 illustrate a lighting fixture 10 in accordance with the present invention. Illustrated lighting fixture 10 includes a frame or support 20, a plurality of quick-disconnect connectors 40 (FIG. 1) attached to support 20, and a plurality of releasably attachable objects 80 (only some of which are shown in FIG. 1), each of the objects being attached to one of the plurality of quick-disconnect connectors 40 (FIG. 1).

As will become apparent from the description below, the lighting fixtures of the present invention may be readily and securely trimmed with the plurality of releasably attachable objects reducing the costs to assemble and produce the lighting fixtures of the present invention compared to lighting fixtures where a wire is wrapping to connect each of the objects to the support. The plurality of releasably attachable objects may also be readily manufactured with simply configured upper ends having an elongated pin to reduce fabrication costs of the objects compared to the cost of fabricating lighting fixtures with objects having complicated hook configurations for attaching the objects to the support. The various lighting fixtures of the present invention also allow a customer to assemble or attach the objects at home, as well as allow the customer to readily disconnect the objects for cleaning or replacement with a new or different object.

Figure 3:
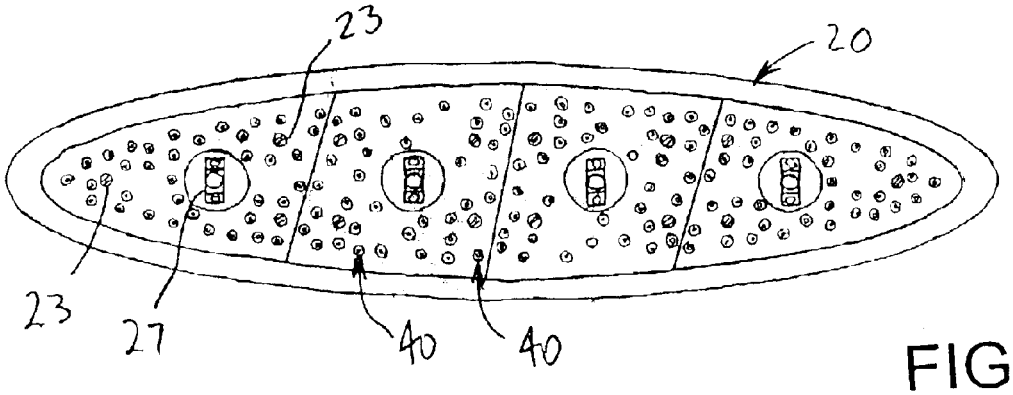
FIG. 3 is a bottom view of the lighting fixture taken along line 3—3 in FIG. 1 illustrating the support and the plurality of quick-disconnect connectors.

As shown in FIG. 1, lighting fixture 10 includes support 20 which in one example, may be elliptical in shape and formed from a horizontal planar top member 22, a spaced-apart horizontal planar bottom member 24, and a sidewall 26 disposed between the top member and the bottom member. The top member may be suitably attached directly to a ceiling or suspended from a ceiling. Bottom member 24 may include a plurality of openings 25 therein. Inside support 20 may be suitable light bulb receptacles 27 (FIGS. 2 and 3) for receiving and supporting a light bulb in each of the plurality of openings for projecting light between the objects. Various floodlights and spotlights may be received in the receptacles. For example, the ends of the lighting fixture may include floodlights and the middle of the lighting fixture may include spotlights. The lighting fixture may use one or more light bulbs. Bottom member 24 may be modular and formed from a plurality of subsections which are connected to top member 22 with suitable bolts 23 as shown in FIGS. 1 and 3. As also shown in FIG. 3, the plurality of quick-disconnect connectors 40 may be attached to bottom member 24 in a suitable pattern for supporting the hanging or suspended objects.

Figure 4:
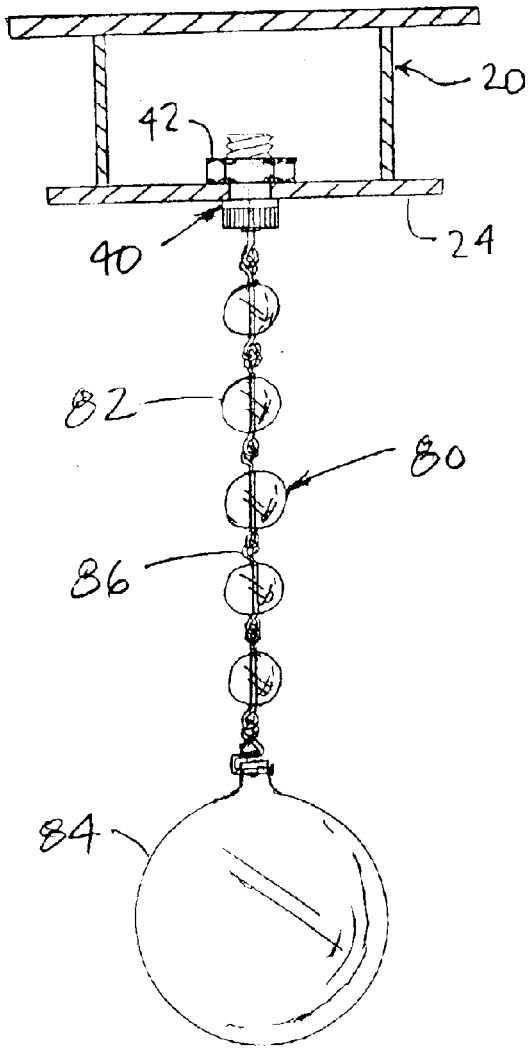
FIG. 4 is an enlarged, elevation view, in part cross-section, taken along line 4—4 in FIG. 1 illustrating a portion of the support, one of the plurality of quick-disconnect connectors, and one of the plurality of releasably attachable objects.

FIG. 4 illustrates an enlarged, side elevation view of a portion of support 20, one of the plurality of quick-disconnect connectors 40, and one of the pluralities of objects 80. For example, bottom member 24 may include a plurality of holes (only one shown in FIG. 4) through which quick-disconnect connector 40 may be attached using a threaded nut 42. Object 80 may include a string of relatively small round crystals 82, and a lower relatively large crystal 84. The crystals may have a bore therein and be connected using a plurality of wire links 86.

Figure 5:
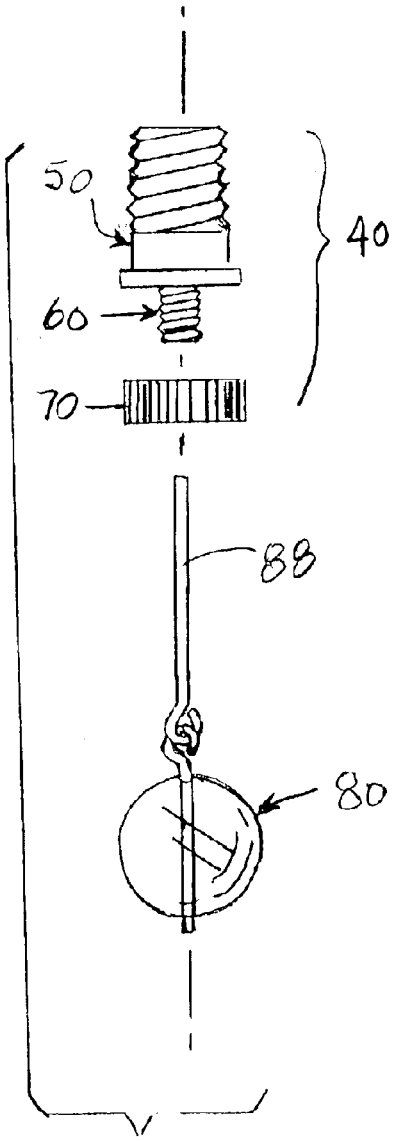
FIG. 5 is an enlarged, exploded, side elevational view of the quick-disconnect connector and the upper portion of the releasably attachable object of FIG. 4.

As best shown in FIG. 5, quick-disconnect connector 40 may include a housing 50, a slidable catch 60, and a knurled locking nut 70. The upper portion of object 80 may include an elongated generally straight pin 88 which is received in slidable catch 60 to suspend object 80 from support 20 as explained in greater detail below.

Figure 6:
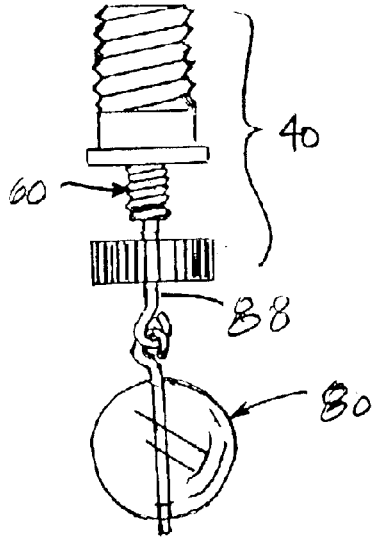
FIG. 6 is a side elevational view of the releasably attachable object initially connected to the quick-disconnect connector of FIG. 5.
Figure 7:
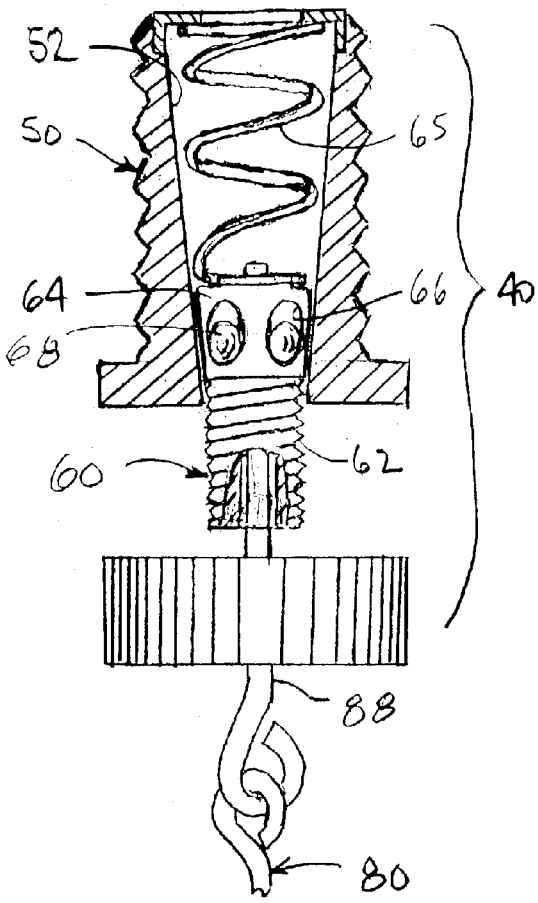
FIG. 7 is an enlarged, side elevational view, in part cross-section, of the releasably attachable object initially connected to the quick-disconnect connector of FIG. 6.

When initially attaching object 80 to quick-disconnect connector 40, as shown in FIGS. 6 and 7, pin 88 is inserted in a vertically-extending passageway (only a portion of which is shown in FIG. 7) in slidable catch 60 which self-locks pin 88 to quick-disconnect connector 60. As best shown in FIG. 7, housing 50 includes a tapered conical passageway 52 therein. Slidable catch 60 may include a lower threaded portion 62 and an upper tapered or conical portion 64. Upper portion 64 may include a plurality of holes 66, such as three equally spaced holes around upper conical portion 64. A plurality of ball bearings 68, such as three ball bearings, may be disposed in holes 66. The self-locking action of the connector is accomplished by a spring 65 which forces slidable catch 60 downwardly.

Figure 8:
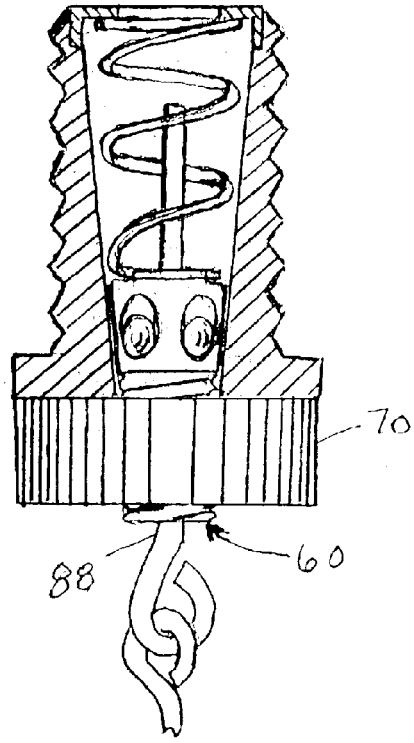
FIG. 8 is a side elevational view, in part cross-section, of the releasably attachable object connected to the quick-disconnect connector of FIG. 6 with the knurled nut secured in place.

When pin 88 is inserted into catch 60, the pin forces the ball bearing and the slidable catch upwardly to compress the spring. The slidable catch which moves upwardly relative to the housing provides a gap between the outer surface of the conical portion and the inner surface of the housing. This allows the pin to slide past the ball bearings. After removing the upward force on the pin, the spring forces the conical portion downwardly to its normal biased position to lock the pin in place by the action of the ball bearings being trapped and wedged between the outer surface of the pin and the inner tapered surface of the housing. The weight of the object also adds to the wedging effect of the ball bearings to hold the object in place. This results in reducing the likelihood of the objects disconnecting and falling from the support. Knurled nut 70 can then be threaded onto slidable catch 60 to securely lock pin 88 in place as shown in FIG. 8.

Figure 9:
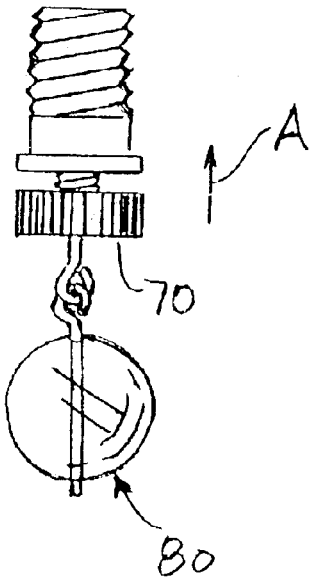
FIG. 9 is a side elevation view of the releasalby attachable object and the quick-disconnect connector of FIG. 6 illustrating removal of the releasably attachable object from the quick-disconnect connector.
Figure 10:
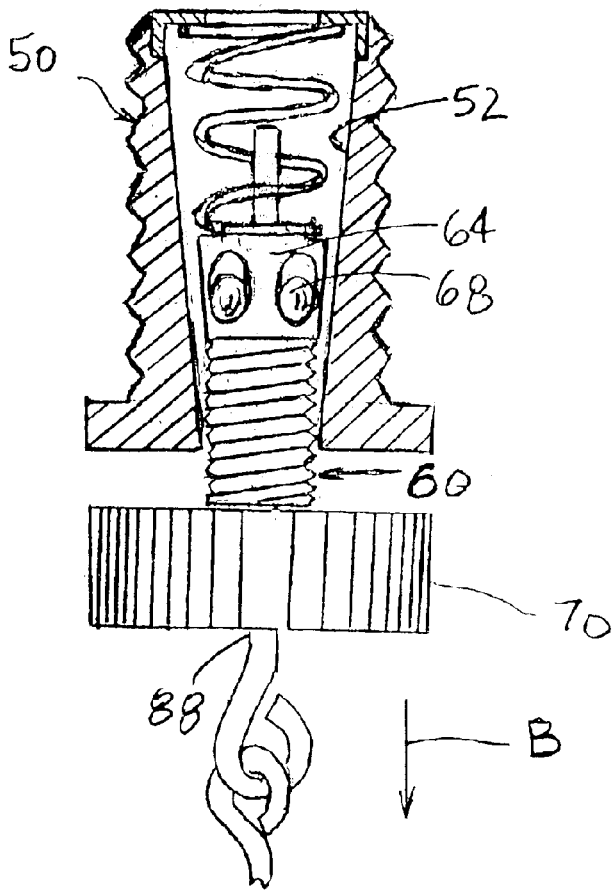
FIG. 10 is an enlarged, side elevation view, in part cross-section, of the releasably attachable object and the quick-disconnect connector of FIG. 9.

To detach object 80 from the support, as shown in FIG. 9, knurled nut 70 is sufficiently unthreaded from slidable catch 60. Thereafter, knurled nut 70 is pushed upwardly in the direction of arrow A so that lower portion of slidable catch may be pushed upwardly to a release position. As best shown in FIG. 10, pushing slidable catch 60 moves conical portion 64 upwardly and away from the inner conical surface 52 of housing 50. This removes the wedging effect of ball bearings 68 on pin 88 so that the pin may be removed, in the direction of arrow B, from the passageway in slidable catch 60, and thus allow detachment of the object from the quick-disconnect connector.

Figure 11:
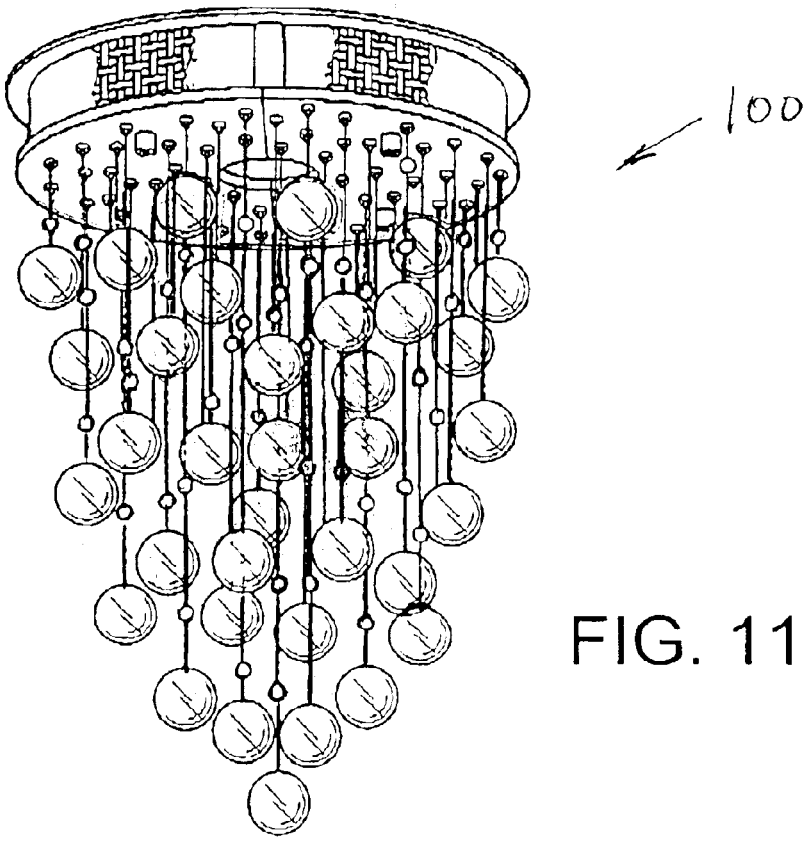
FIG. 11 is an alternative embodiment of a lighting fixture having a plurality of releasably attachable objects in accordance with the present invention.
Figure 12:
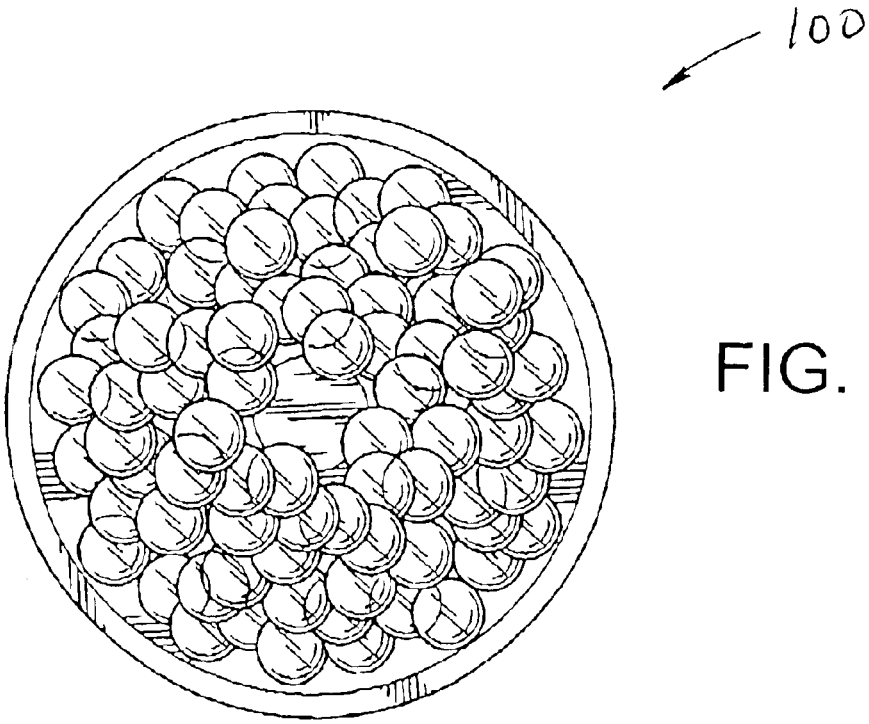
FIG. 12 is a bottom view of the lighting fixture of FIG. 11.

FIGS. 11 and 12 illustrate an alternative embodiment of a lighting fixture 100 in accordance with the present invention. Illustrated lighting fixture 100 is generally similar to lighting fixture 10 with the exception that the support is round and the objects are disposed in a circular pattern.

While the lighting fixtures described above and illustrated may have an elliptical or round configuration, it will be appreciated that lighting fixtures in accordance with the present invention may have a square, rectangular, triangular, hexagonal, irregular configuration, or combinations thereof. The support may be fabricated from a metal such as aluminum or any suitable material. The support may be unadorned, adorned (e.g., with a mesh material), or include any other decoration. In addition, a lighting fixture employing the features of the present invention may have a central portion with arms, and the quick-disconnect connectors may be attached to the arms. A lighting fixture in accordance with the present invention may also have any suitable configuration for supporting ornaments or objects therefrom using the quick-disconnect connectors. Further, lighting fixtures in accordance with the present invention may also be configured as table lamps, wall sconces, chandeliers, luminaires, and pendants.

The quick-disconnect connectors may be suitable cable grips. Suitable cable grips such a GRIPLOCK gliders are available from GRIPLOCK Systems of Carpinteria, Calif., model Y4IP-KFts(25). Suitable cable grips are also available from Arakawa Hanging Systems of Portland, Oreg. Conventionally, cable grips are used to suspend a lighting fixture from a ceiling and allow level adjustment of the light fixture.

In addition, other suitable quick-disconnect connectors such as quick-disconnect connectors typically used on key chains may also be suitably employed in the lighting fixtures in accordance with the present invention. Still other suitable quick-disconnect connectors may include quick-disconnect connectors having one or more ball bearings or spring biased detents, resilient materials having teeth or catches, or other configurations having a normal self-locking position and a second releasable position. It will also be appreciated that either the support or the object may include the quick-disconnect connector. If two portions form the quick-disconnect connector, the support or the object may have either of the two halves which form the quick-disconnect connector.

The objects or ornaments supported from the quick-disconnect connectors may be round, faceted, or have any other shape, or combinations thereof. The objects or ornaments may also be fabricated from glass, crystal, plastic, metal, stone, or any other suitable material, and combinations thereof. The objects or ornaments may also be clear or translucent, opaque, solid, colored, or combinations thereof. The objects or ornaments may further be connected by a series of solid wires and linked together. The objects or ornaments may also be suitably strung on a solid wire or braided wire or cable, the upper end of which is received in or connectable to the quick-disconnect connectors. In addition, a lighting fixture in accordance with the present invention may include some of the objects or ornaments attached to the support by quick-disconnect connectors, and some of the objects or ornaments being permanently attached to the support (e.g., by wrapping a wire to attach the objects or ornaments to the support structure). The shape of the length of the various suspended objects may be varied to provide any configuration. The objects may also be replaced with one or more different objects to provide the lighting fixture with a different look. The quick-disconnect connectors may also be attached to the support in orientations other than that shown in the figures. For example, the passageway in the quick-disconnect may be disposed horizontally or at an angle.

From the present description, it will be appreciated by those skilled in the art that the present invention provides a lighting fixture and ornaments which may be readily and inexpensively assembled. For example, the support may be fabricated, the quick-disconnect connectors attached to the support, and the object connected to the quick-disconnect connectors. The objects may be connected by a manufacturer or by the purchaser or consumer.

Thus, while various embodiments of the present invention have been illustrated and described, it will be appreciated by those skilled in the art that many further changes and modifications may be made thereunto without departing from the spirit and scope of the invention.

What is claimed is:

1. A lighting fixture comprising:

a support;

a plurality of objects;

a plurality of quick-disconnect connectors comprising a plurality of cable grips connected to said support for hanging said plurality of objects from said support; and wherein said plurality of quick-disconnect connectors comprises a first self-locking position for connecting said plurality of objects to said support and a second releasable position for disconnecting said plurality of objects from said support.

2. The lighting fixture of claim 1 wherein said plurality of objects comprises a plurality of elongated pins connectable to said quick-disconnect connectors.

3. The lighting fixture of claim 1 wherein said plurality of quick-disconnect connectors comprises a plurality or knurled nuts for securing said plurality of cable grips in said first self-locking position.

4. The lighting fixture of claim 1 wherein said plurality of quick-disconnect connectors comprises a plurality of vertically-extending passageways in which is receivable a portion of said plurality of objects.

5. The lighting fixture of claim 1 wherein said plurality of objects comprises a plurality of elongated straight pins connectable to said plurality of quick-disconnect connectors.

6. The lighting fixture of claim 1 wherein said plurality of quick-disconnect connectors is attached to a horizontal bottom member of said support.

7. The lighting fixture of claim 1 wherein said plurality of objects comprises a plurality of vertically suspended crystal ornaments.

8. The lighting fixture of claim 1 wherein said support comprises a horizontal planar member to which said plurality of quick-disconnect connectors are attached, and said plurality of objects comprises a plurality of varying lengths of crystal ornaments.

9. The lighting fixture of claim 1 wherein said support comprises at least one of an elliptical bottom member to which said plurality of quick-disconnect connectors are attached, and a round bottom member to which said plurality of quick-disconnect connectors are attached.

10. The lighting fixture of claim 1 wherein said support comprises an elliptical planar top member, a spaced-apart elliptical planar bottom member to which said plurality of quick-disconnect connectors are attached, and a sidewall disposed therebetween, said bottom member comprises at least one opening for receiving at least one light bulb, and wherein said plurality of objects comprises a plurality of crystal ornaments.

11. The lighting fixture of claim 1 wherein said support comprises a round planar top member, a spaced-apart round planar bottom member to which said plurality of quick-disconnect connectors are attached, and a sidewall disposed therebetween, said bottom member comprises at least one opening for receiving at least one light bulb, and wherein said plurality of objects comprises a plurality of crystal ornaments.

12. A lighting fixture comprising:

a support having a horizontal bottom member;

a plurality of objects, each of said plurality of objects having an elongated pin;

a plurality of cable grips attached to said bottom member of said support for suspending said plurality of objects by said plurality of elongated pins from said support; and wherein said plurality of cable grips comprises a first self-locking position for connecting said plurality of objects to said support and a second releasable position for disconnecting said plurality of objects from said support.

13. The lighting fixture of claim 12 wherein said plurality of cable grips comprises a plurality of knurled nuts for securing said plurality of cable grips in said first self-locking position.

14. The lighting fixture of claim 12 wherein said plurality of objects comprises a plurality of crystal ornaments.

15. The lighting fixture of claim 12 wherein said plurality of cable grips comprises a plurality of vertically extending passageways in which are receivable said plurality of elongated pins.

16. The lighting fixture of claim 12 wherein said plurality of objects comprises a plurality of varying lengths of crystal ornaments.

17. The lighting fixture of claim 12 wherein said bottom member comprises at least one of an elliptical bottom member and a round bottom member.

18. The lighting fixture of claim 12 wherein said bottom member comprises an elliptical planar bottom member, said support further comprising a spaced-apart elliptical planar top member, a sidewall disposed between said bottom member and said top member, and said bottom member comprises at least one opening for receiving at least one light bulb, and wherein said plurality of objects comprises a plurality of crystal ornaments.

19. The lighting fixture of claim 12 wherein said bottom member comprises a round planar bottom member, said support further comprising a spaced-apart round planar top member, a sidewall disposed between said bottom member and said top member, and said bottom member comprises at least one opening for receiving at least one light bulb, and wherein said plurality of objects comprises a plurality of crystal ornaments.

20. A method for trimming a lighting fixture, the method comprising:

connecting a plurality of objects to a support with a plurality of quick-disconnect connectors comprising a plurality of cable grips.

21. The method of claim 20 further comprising attaching the plurality of quick-disconnect connectors to the support.

22. The method of claim 20 further comprising attaching the plurality of quick-disconnect connectors to a bottom member of the support.

23. The method of claim 20 wherein the plurality of objects comprises a plurality of elongated pins connectable to the plurality of cable grips.

24. The method of claim 23 wherein the plurality of cable grips comprises a plurality of vertically-extending passageways in which is receivable the plurality of elongated pins.

25. The method of claim 20 wherein the support comprises an elliptical planar top member, a spaced-apart elliptical planar bottom member, and a sidewall disposed therebetween, the bottom member comprises at least one opening for receiving at least one light bulb, and wherein the plurality of objects comprises a plurality of crystal ornaments.

26. The method of claim 20 wherein the support comprises a round planar top member, a spaced-apart round planar bottom member, and a sidewall disposed therebetween, the bottom member comprises at least one opening for receiving at least one light bulb, and wherein the plurality of objects comprises a plurality of crystal ornaments.

27. A method for forming a light fixture, the method comprising:

providing a support; and attaching a plurality of quick-disconnect connectors comprising a plurality of cable grips to the support for connecting to a plurality of.

28. The method of claim 27 further comprising connecting a plurality of objects to the plurality of quick-disconnect connectors.

29. The method of claim 27 wherein the plurality of objects comprises a plurality of elongated pins connectable to the plurality of cable grips.

30. The method of claim 29 wherein the plurality of cable grips comprises a plurality of vertically-extending passageways in which is receivable the plurality of elongated pins.

31. The method of claim 27 wherein the support comprises an elliptical planar top member, a spaced-apart elliptical planar bottom member, and a sidewall disposed therebetween, the bottom member comprises at least one opening for receiving at least one light bulb, and wherein the plurality of objects comprises a plurality of crystal ornaments.

32. The method of claim 27 wherein the support comprises a round planar top member, a spaced-apart round planar bottom member, and a sidewall disposed therebetween, the bottom member comprises at least one opening for receiving at least one light bulb, and wherein the plurality of objects comprises a plurality of crystal ornaments.

33. A lighting fixture comprising:

a support;

a plurality of objects comprising a plurality of elongated straight pins connectable to a plurality of quick-disconnect connectors;

said plurality of quick-disconnect connectors connected to said support for hanging said plurality of objects from said support; and wherein said plurality of quick-disconnect connectors comprises a first self-locking position for connecting said plurality of objects to said support and a second releasable position for disconnecting said plurality of objects from said support.

* * * * *

UNITED STATES PATENT AND TRADEMARK OFFICE

CERTIFICATE OF CORRECTION

PATENT NO. : 6,863,423 B2
DATED : March 8, 2005
INVENTOR(S) : Stone et al.

It is certified that error appears in the above-identified patent and that said Letters Patent is hereby corrected as shown below:

Column 8,
Line 7, insert the word -- objects. -- after the word "of" at the end of the sentence.

Signed and Sealed this

Twenty-fourth Day of May, 2005

JON W. DUDAS
*Director of the United States Patent and Trademark Office*